United States Patent [19]

Meyer

[11] 4,308,133

[45] Dec. 29, 1981

[54] FROTH PROMOTOR FOR FLOTATION OF COAL

[75] Inventor: Wilfred C. Meyer, Midland, Mich.

[73] Assignee: The Dow Chemical Company, Midland, Mich.

[21] Appl. No.: 161,244

[22] Filed: Jun. 20, 1980

[51] Int. Cl.[3] ..... B03D 1/02

[52] U.S. Cl. ..... 209/166

[58] Field of Search ..... 209/166, 167

[56] References Cited

U.S. PATENT DOCUMENTS

| | | | |
|---|---|---|---|
| 1,655,849 | 1/1928 | Stenning | 209/166 X |
| 1,660,009 | 2/1928 | Kuhlwein | 209/166 X |
| 1,667,277 | 4/1928 | Wilkinson | 209/166 |
| 2,088,624 | 8/1937 | Tschudy | 209/167 X |
| 2,102,370 | 12/1937 | Merriss | 209/166 |
| 2,433,258 | 12/1947 | Booth | 209/166 |
| 2,695,101 | 11/1954 | Booth | 209/166 |
| 3,079,331 | 2/1963 | Gieseke | 210/53 |
| 3,595,390 | 7/1971 | Booth | 209/166 |
| 3,790,213 | 11/1973 | Lynn | 209/166 |
| 4,172,029 | 10/1979 | Hefner | 209/166 |

FOREIGN PATENT DOCUMENTS

| | | | |
|---|---|---|---|
| 609131 | 9/1948 | United Kingdom | 209/163 |

OTHER PUBLICATIONS

Chem. Abst. 69, 1968, 20978c.
Chem. Abst. 71, 1969, 14865p.
Chem. Abst. 80, 1974, 110670c.
Chem. Abst. 81, 1974, 172776w.

*Primary Examiner*—Robert Halper
*Attorney, Agent, or Firm*—M. L. Glenn

[57] ABSTRACT

Aromatic polycyclic, hydrocarbon compounds bearing at least one nuclear sulfonic acid or sulfonate moiety are useful as froth promoters to improve the recovery of clean coal in the froth flotation of finely-divided coal. Disulfonated diphenyl ether compounds bearing at least one nuclear alkyl group of from 10 to 22 carbon atoms are particularly efficacious.

8 Claims, No Drawings

FROTH PROMOTOR FOR FLOTATION OF COAL

BACKGROUND OF THE INVENTION

This invention relates to the froth flotation of coal-containing ashes, coal sludge or coal-containing residues to recover coal containing a lower percentage of impurities. In particular, this invention relates to the use of an aromatic polycyclic, hydrocarbon compound bearing at least one nuclear sulfonic acid or sulfonate moiety as a froth promoter for the flotation of finely-divided coal in the presence of a conventional frother.

The natural process of "coalification" inherently deposits some non-combustible mineral matter in association with the combustible carbonaceous solids. Large fragments of non-combustible material can be removed by screening or other gravity concentration techniques, but other cleaning methods more efficiently remove fine material intimately associated with the carbonaceous solids. Froth flotation of coal is used in the art to beneficiate finely-divided raw coal. Bituminous coals generally possess a natural hydrophobicity, which results in the coal being floatable in the presence of a frother, such as methyl isobutyl carbinol, desirably with a relatively mild collector, such as kerosene. Anthracite coals, as well as coals of all ranks in which the surface has been at least partially oxidized, are less amenable to flotation, resulting in the loss of significant amounts of combustible material with the tail fraction from the flotation.

SUMMARY OF THE INVENTION

According to this invention, coal is beneficiated in a froth flotation process comprising floating coal particles of flotation size in a frothing aqueous medium in the presence of an effective amount of a froth promoter corresponding to the formula I

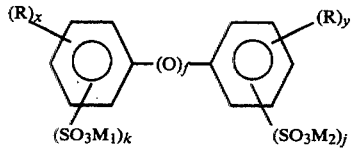

I wherein x and y are each independently the integer 0 or 1;

k and j are each independently the integer 0 or 1 with the proviso that the sum of k and j is at least 1;

each R is an alkyl radical and each R can be the same or different;

f is the integer 0 or 1; and $M_1$ and $M_2$ are each independently a hydrogen, an alkali metal, or a primary or secondary ammonium moiety.

DETAILED DESCRIPTION OF THE INVENTION

Froth Promoter

The aryl sulfonate used as a froth promoter in the practice of this invention is a sulfonated diphenyl ether or biphenyl compound optionally bearing nuclear alkyl substituents. The sulfonated diphenyl ether is preferred. Preferably, this aryl sulfonate compound bears at least one nuclear alkyl radical having from 8 to about 20, more preferably 10 to about 18, more preferably 12 carbon atoms. The alkyl radical can be branched or linear. A mixture of these aryl sulfonate compounds is also operable.

The identity of the moiety corresponding to $M_1$ or $M_2$ in the formula of the aryl sulfonate compound can greatly affect the activity of the promoter. The activity of the aryl sulfonates containing an ammonium moiety bearing one or two alkyl groups is especially unpredictable. Preferably, $M_1$ and $M_2$ are each a sodium or potassium cation.

The aryl sulfonate compounds described herein can be prepared, in general, by methods known to the art. U.S. Pat. No. 2,854,477 discloses a method of preparing alkyl diphenyl ether sulfonates. In one preferred method, a diphenyl ether or biphenyl compound is alkylated by reacting it with an olefin in the presence of a Friedel-Crafts catalyst. The alkylated aryl compound is then sulfonated by contacting it with sulfur trioxide in refluxing sulfur dioxide. This process produces a high degree of sulfonation (i.e., both of the phenyl moieties in the compound are sulfonated), which is preferred.

Flotation of Coal

The coal to be floated by the instant process is preferably anthracite or bituminous coal, which floats readily in an aqueous medium in the presence of a frother and fuel oil. This process is operable, but not as advantageous, in floating oxidized coals or coals of lower grades which are not so readily floated.

The particle size of the coal flotation feed is important, as particles larger than about 28 mesh (U.S. Sieve Size) are difficult to float. In typical operations, coal particles larger than about 28 mesh, preferably larger than 100 mesh, are separated from both the bulk of the inert matter mined therewith and more finely-divided coal by gravimetric separation techniques. However, if a substantial fraction of the coal in the flotation feed is contained in particles larger than 28 mesh, it is desirable that the feed is comminuted prior to flotation.

The sized coal flotation feed in preparation for flotation is first optionally washed and then mixed with sufficient water to prepare an aqueous slurry having a concentration of solids which promotes rapid flotation. Generally, a solids concentration of from about 2 to about 20 weight percent solids, more preferably about 5 to about 15 weight percent, is preferred. The aqueous coal slurry is desirably conditioned with a frother, froth promoter and other adjuvants by mixing or agitating the slurry prior to flotation in a manner known to the art. In a preferred embodiment, fuel oil is added to the aqueous coal slurry followed by agitation and then the frother and froth promoter are introduced to the medium contemporaneously. However, the order of addition of the fuel oil, frother and froth promoter to the aqueous coal slurry is not critical, so long as the flotation operation is carried out before the froth subsides significantly.

A frothing agent should be present in the coal flotation medium to engender formation of a froth. Conventional frothers, such as pine oil, cresol, isomers of amyl alcohol and other branched $C_4$–$C_8$ alkanols are suitable for this purpose. However, methyl isobutyl carbinol, diisobutyl carbinol, 2-ethyl-1-hexanol, and polypropylene glycol alkyl or phenyl ethers are preferred as frothers, with polypropylene glycol methyl ethers and polypropylene glycols having a weight average molecular weight of from 200 to 600 being more preferred. The optimal loading of frother in the flotation medium is influenced by a number of factors, most important of which is the particle size, rank and degree of oxidation of the coal. Generally, a ratio of from 0.05 to about 0.5 kilogram of frother per metric ton of coal feed is advantageous. In one preferred embodiment, the frother is a mixture of from about 90–96 weight percent of a polypropylene glycol having a weight average molecular weight of about 400 with a remaining amount of 2-ethyl-1-hexanol. This preferred embodiment is especially useful where $M_1$ in formula I is a primary ammonium moiety bearing a $C_4$–$C_8$ alkyl group and $M_2$ is a sodium ion. Mixtures of polypropylene glycols and diisobutyl carbinol are also preferred.

The loading of the froth promoter in the flotation medium which effects the greatest recovery of combustible carbonaceous matter with a tolerable amount of inert matter is dependent upon such factors as the particle size, rank, degree of oxidation and inert matter content of the coal feed, as well as the loading and identity of the frother and other adjuvants. The loading of the froth promoter is critical, inasmuch as too much of the froth promoter deleteriously affects the coal recovery during flotation. The term "effective amount" is used herein to denote an amount of froth promoter which increases the coal recovered by froth flotation in the presence of a frother and other flotation adjuvants relative to the coal recovered under like conditions where no froth promoter is present. Generally, where the froth promoter is employed with only a frother and fuel oil, the froth promoter is advantageously employed in a ratio of from about 0.0005 to about 0.1, preferably about 0.001 to about 0.05, kilogram of froth promoter per metric ton of coal feed. Typically, the froth promoter employed will be from about 1 to about 20 percent by weight of the frother added. The froth promoter is generally most efficacious where slightly less frother is employed than would be most effective in the absence of the froth promoter. The loading of froth promoter should be optimized empirically to effect the greatest selectivity and recovery during flotation.

The instant frother and froth promoter can be utilized in conjunction with other adjuvants, such as activators, conditioning reagents, dispersing reagents and depressing reagents. Fuel oil is advantageously employed in the flotation medium as a collector and/or dispersing reagent. Representative fuel oils include diesel oil, kerosene, Bunker C fuel oil, mixtures thereof and the like. The fuel oil can generally be advantageously employed in a ratio of from about 0 to about 2.5 kilograms fuel oil per metric ton of coal flotation feed. The optimal loading of fuel oil in the flotation medium is influenced by numerous factors, such as the size, degree of oxidation and rank of the coal to be floated and the loading of froth promoter and frother. Therefore, the loading of the fuel oil must also be optimized empirically to effect the greatest selectivity and recovery during flotation.

The coal is operably floated at the natural pH of the coal in the aqueous slurry, which can vary from about 4.0 to about 9.5 depending upon the composition of the feed. However, a pH adjusting composition is optionally used as necessary to adjust and maintain the pH of the aqueous coal slurry prior to and during flotation. Generally, a pH of from about 4 to about 9, preferably about 6 to about 8, promotes the greatest coal recovery. If the coal is acidic in character, the pH adjusting composition can operably be an alkaline material, such as soda ash, lime, ammonia, potassium hydroxide or magnesium hydroxide, with sodium hydroxide being preferred. If the aqueous coal slurry is alkaline in character, a carboxylic acid, such as acetic acid and the like, or a mineral acid, such as sulfuric acid, hydrochloric acid and the like, are operable to adjust the pH.

The conditioned and pH-adjusted aqueous coal slurry is aerated in a conventional flotation machine or bank of rougher cells to float the coal. Any conventional rougher flotation unit can be employed.

The practice of the process of the instant invention can be used to beneficiate coal without the aid of secondary processes. Alternatively, the process can be used in conjunction with secondary flotations following the instant process to effect even greater beneficiation of the coal.

The following examples are illustrative embodiments of this invention. Unless otherwise indicated, all parts and percentages are by weight. "Tons" refers to metric tons.

EXAMPLE 1

In a series of substantially identical flotation runs that differ in the identity of the frother and presence or absence of a froth promoter, a 50 gram charge of comminuted coal is diluted with deionized water to a slurry of 3.6 percent solids. The coal is a low grade, bituminous Pittsburgh seam coal containing 12.95 percent ash. The fraction of the coal feed consisting of particles larger than 25 mesh is separated before dilution, comminuted and then recombined with the remainder of the coal. The comminuted coal feed is more than 80 percent particles smaller than 45 mesh.

The aqueous coal slurry is introduced into a flotation machine (specifically a Galigher Agitair Flotation Machine) having a 1.5 liter cell. The coal slurry is agitated for about six minutes to thoroughly wet the coal, at which time a refined kerosene (sold under the tradename Soltrol 100 by Phillips Petroleum Co.) is added to the slurry to effect a loading of about 0.68 kilogram of kerosene per ton of coal feed. The slurry is agitated for one minute to condition the coal. A polypropylene glycol having a weight average molecular weight of about 400 is added to the slurry as a frother to effect a loading of 0.11 kilogram frother per ton of coal feed. In one flotation run embodying the instant process, a sodium salt of a dodecylated disulfonated diphenyl ether is added as an aqueous solution with the frother in a loading of about 0.016 kilogram of the froth promoter per ton of coal feed. The sulfonated diphenyl ether is a mixture of monoalkylated and dialkylated compounds, wherein the alkyl is a branched $C_{12}$ alkyl. Two control flotation runs not embodying the present invention are also made in which no froth promoter is added to the slurry; in one of these runs an equivalent weight amount of frother replaces the froth promoter. After the frother is added to the slurry, the slurry is conditioned by agitation for one minute. Aeration of the medium is initiated and continued for four minutes. The frothy concentrate is collected during aeration.

The collected concentrate is first dried in an oven and weighed. The percent recovery of coal by flotation is determined from the weight of clean coal (i.e., total weight of material less weight of ash present) in the concentrate divided by the weight of clean coal in the 50 gram charge. A one-gram sample of the concentrate is completely burned and the ash content of the concentrate is determined from the weight of the material remaining after combustion. Table I tabulates whether froth promoter is employed in each run, as well as the percent recovery of coal and the ash content in the concentrate.

TABLE I

| Run | Froth Promoter | Coal Recovery | Ash Content |
|---|---|---|---|
| A* | None | 61.6% | 6/32% |
| B | Yes | 70.8% | 6.66% |
| C* | ** | 64.0% | 6.40% |

EXAMPLE 2

A series of substantially identical flotation runs are performed in the same manner as Example 1, except that diisobutyl carbinol is employed as a frother instead of the polypropylene glycol. The results are tabulated in Table II.

TABLE II

| Run | Froth Promoter | Coal Recovery | Ash Content |
|---|---|---|---|
| D* | None | 59.0% | 6.31% |
| E | Yes | 69.0% | 6.79% |
| F* | ** | 64.2% | 6.82% |

*Not an embodiment of this invention.
**Diisobutyl carbinol added in place of froth promoter.

EXAMPLE 3

In a series of three substantially identical flotation runs that differ in the identity of the cation "$M_1$" and "$M_2$" in the froth promoter employed, 200 grams of coal are diluted with deionized water to produce a slurry having 6.7 percent solids. The coal slurry is introduced to the 3-liter cell of a flotation machine. The coal slurry is agitated for six minutes followed by the addition of sufficient refined kerosene to effect a loading of 0.68 kilogram per ton of coal feed. The slurry is then agitated for an additional minute.

The frother employed in Example 1 is added to the slurry as a 50 percent aqueous solution to effect a loading of 0.114 kilogram of frother per ton of coal feed. A froth promoter is also added in a 50 percent aqueous solution to effect a loading of 0.006 kilogram of promoter per ton of coal. The froth promoters employed in the three runs are represented by formula I, wherein k, j and f are each 1, the sum of x and y is 1 or 2; R is dodecyl and $M_1$ is a sodium ion and $M_2$ is a sodium ion in one of these runs and an ammonium ion bearing an alkyl group in the other two runs. In one of the flotation runs, the alkyl group on the ammonium ion is t-octyl and in another run the alkyl group is butyl. A control run not embodying the invention is also made where an equivalent weight of frother replaces the froth promoter.

After the frother is added to the slurry, the slurry is conditioned by agitation for one minute. Aeration of the medium is initiated and continued for four minutes. The collected concentrate is dried and the coal recovery and ash content is determined in the manner described in Example 1. The experimental results are tabulated in Table III along with the identity of $M_1$ and $M_2$ for each of the froth promoters.

TABLE III

| Run | Froth Promoter | $M_1$ | $M_2$ | % Coal Recovery | % Ash Content |
|---|---|---|---|---|---|
| G | Yes | $Na^{\oplus}$ | $H_3N^{\oplus}$-(-t-octyl) | 76.1 | 4.12 |
| H* | Yes | $Na^{\oplus}$ | $H_3N^{\oplus}$-(-butyl) | 73.0 | 4.07 |
| J | Yes | $Na^{\oplus}$. | $Na^{\oplus}$ | 81.1 | 4.69 |

TABLE III-continued

| Run | Froth Promoter | $M_1$ | $M_2$ | % Coal Recovery | % Ash Content |
|---|---|---|---|---|---|
| K* | None | — | — | 74.3 | 4.04 |

The froth promoter wherein $M_2$ is an ammonium group bearing a butyl functionality does not enhance the recovery of coal.

EXAMPLE 4

A series of flotation runs are performed in the same manner as Example 3, except that the frother contains 5 percent 2-ethyl-1-hexanol. The experimental results are tabulated in Table IV.

TABLE IV

| Run | Froth Promoter | $M_1$ | $M_2$ | % Coal Recovery | % Ash Content |
|---|---|---|---|---|---|
| L | Yes | $Na^{\oplus}$ | $H_3N^{\oplus}$-(-t-octyl) | 87.2 | 4.50 |
| M | Yes | $Na^{\oplus}$ | $H_3N^{\oplus}$-(-butyl) | 89.5 | 5.71 |
| N | Yes | $Na^{\oplus}$ | $Na^{\oplus}$ | 88.1 | 6.00 |
| P* | None | — | — | 82.7 | 5.60 |

*Not an embodiment of this invention.

EXAMPLE 5

A series of three flotation runs are performed in a manner similar to Example 1. A 100 gram charge of coal of Australian origin is diluted with deionized water to produce a slurry containing 6.2 percent solids. The aqueous coal slurry is introduced into a 1.5 liter cell and then agitated for several minutes. A refined kerosene is added to the slurry to effect a loading of about 0.66 kilogram of kerosene per ton of coal feed. The slurry is agitated to condition the coal.

A polypropylene glycol having a weight average molecular weight of about 400 is added to the slurry to effect a loading of 0.12 kilogram of this frother per ton of coal. Sufficient 2-ethylhexanol is added to effect a loading of 0.009 kilogram per ton of coal feed.

In each of the runs, 0.0009 gram of a sodium salt of an alkylated disulfonated diphenyl ether is added to the aqueous coal slurry. This sulfonated diphenyl ether is in each run a mixture of monoalkylated and dialkylated compounds. In the first run the alkyl group borne by the sulfonated diphenyl ether is a branched $C_{12}$ alkyl, in the second a linear $C_{10}$ and in the third it is a linear $C_{16}$ alkyl.

The aqueous coal slurry is aerated and the froth collected. The collected concentrate is dried in an oven and weighed. In this example no determination of the ash content of the concentrate is made, but the percentage of the feed recovered is tabulated in Table V.

TABLE V

| Run | Alkyl Group | % Recovery |
|---|---|---|
| Q | $C_{12}$ | 78.3 |
| R | $C_{10}$ | 75.7 |
| S | $C_{16}$ | 73.5 |

What is claimed is:

1. A froth flotation process for beneficiating coal comprising floating coal particles of flotation size in a frothing aqueous medium in the presence of an effective amount of a froth promoter corresponding to the formula

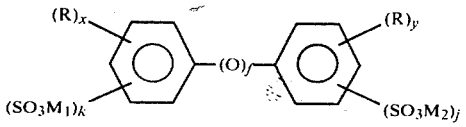

wherein x and y are each independently the integer 0 or 1;

k and j are each independently the integer 0 or 1 with the proviso that the sum of k and j is at least 1;

each R is an alkyl radical and each R can be the same or different;

f is the integer 1; and $M_1$ and $M_2$ are each independently sodium or potassium.

2. The process as described in claim 1 wherein the sum of x and y is at least 1 and R is an alkyl group having from 8 to about 20 carbon atoms.

3. The process as described in claim 2 wherein R is an alkyl having from 10 to about 18 carbon atoms.

4. The process as described in claim 2 wherein the aqueous medium contains a sufficient quantity of methyl isobutyl carbinol, diisobutyl carbinol, 2-ethyl-1-hexanol, polypropylene glycol ethyl ether or polypropylene glycol phenyl ether to produce a froth.

5. The process as described in claim 2 wherein the aqueous medium contains a polypropylene glycol methyl ether or a polypropylene glycol having a weight average molecular weight of from 200 to 600 as a frother.

6. The process as described in claim 5 wherein the aqueous medium contains a frother mixture of a branched $C_4$–$C_8$ alkanol and a predominant amount of polypropylene glycol having a weight average molecular weight from 200 to 600.

7. The process as described in claim 1 wherein k and j are each 1.

8. A froth flotation process for beneficiating coal comprising floating coal particles of flotation size in a frothing aqueous medium containing a frother mixture of a branched $C_4$–$C_8$ alkanol and a predominant amount of polypropylene glycol having a weight average molecular weight from 200 to 600 and an effective amount of a froth promoter corresponding to the formula

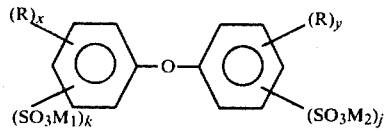

wherein x and y are each independently the integer 0 or 1 and the sum of x and y is at least 1;

k and j are each independently the integer 0 or 1 with the proviso that the sum of k and j is at least 1;

each R is a $C_8$ to $C_{20}$ alkyl radical and each R can be the same or different; and $M_1$ is sodium and $M_2$ is a primary ammonium bearing a $C_4$–$C_8$ alkyl.

* * * * *

UNITED STATES PATENT AND TRADEMARK OFFICE

CERTIFICATE OF CORRECTION

PATENT NO. : 4,308,133

DATED : December 29, 1981

INVENTOR(S) : Wilfred C. Meyer

It is certified that error appears in the above—identified patent and that said Letters Patent is hereby corrected as shown below:

Column 5, line 6, Table I, first item under the heading "Ash Content", "6/32%" should read -- 6.32 --.

Column 5, Table I, the first footnote should read, -- *Not an embodiment of this invention. --

Column 5, Table I, the second footnote should read, -- **Additional frother added in place of promoter. --

Column 6, Table III, the footnote should read, -- *Not an embodiment of this invention. --

Signed and Sealed this

Twenty-fifth Day of May 1982

[SEAL]

Attest:

GERALD J. MOSSINGHOFF

Attesting Officer

Commissioner of Patents and Trademarks